US006451085B1

(12) United States Patent
Kamikawa et al.

(10) Patent No.: US 6,451,085 B1
(45) Date of Patent: Sep. 17, 2002

(54) METHOD FOR PRODUCING REDUCED IRON

(75) Inventors: Susumu Kamikawa, Hiroshima (JP); Kouichi Hirata, Hiroshima (JP); Hironori Fujioka, Hiroshima (JP); Hideaki Mizuki, Hiroshima (JP); Keiichi Sato, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/612,373

(22) Filed: Jul. 7, 2000

(30) Foreign Application Priority Data

Sep. 10, 1999 (JP) ..... 11-256878

(51) Int. Cl.[7] ..... C21B 13/08
(52) U.S. Cl. ..... 75/479; 75/481

(58) Field of Search ..... 75/481, 479, 503, 75/504

(56) References Cited

U.S. PATENT DOCUMENTS 2,523,138 A * 9/1950 Oppegaard
2,663,632 A * 12/1953 Oppegaard
3,235,375 A * 2/1966 Meyer et al.
4,701,214 A * 10/1987 Kaneko et al. ..... 75/481

* cited by examiner

*Primary Examiner*—Ngoclan Mai

(57) ABSTRACT

In the production of reduced iron by agglomerating a mixed powder of an iron material and a reducing agent to form compacts like briquettes or pellets, and reducing the compacts in a high temperature atmosphere, when the temperature of reduced compacts is 900° C. or higher, the oxide content in the reduced compacts is set at 11% or more, and the basicity of the reduced compacts is set at 0.5 or higher.

3 Claims, 8 Drawing Sheets

METHOD FOR PRODUCING REDUCED IRON

BACKGROUND OF THE INVENTION

1. Field of the Invention

The present invention relates to a method and an apparatus for producing reduced iron by mixing a powder of an iron material and a powder of a reducing agent to form a mixed powder, agglomerating the mixed powder to form compacts like briquettes or pellets, and reducing the compacts in a high temperature atmosphere.

2. Description of the Related Art

FIG. 8 outlines a production process by a conventional apparatus for producing reduced iron.

In a conventional apparatus for producing reduced iron, as shown in FIG. 8, an iron ore powder, a coal powder, and a binder are mixed in a mixer (not shown) . The resulting mixed powder is agglomerated by a pelletizer or a briquetter 001 to form green compacts (raw compacts). Then, the green compacts are charged into a dryer 002, where they are dried with an off-gas from a reducing furnace (a rotary hearth furnace, RHF) 004 to be described later on. The so dried green compacts are fed to the RHF 004 by a compact feeder 003. The interior of the RHF 004 is heated by burners 005, and thereby maintained in a high temperature atmosphere. The off-gas inside the RHF 004 is discharged from an off-gas duct 006.

The green compacts are heated with the radiant heat of a high temperature gas while they are moving in the RHF 004. Iron oxide in the iron ore is reduced with coal to form reduced iron in compact form. The reduced compacts are discharged by a compact discharger 007, and accommodated into a reservoir 008. The off-gas discharged through the off-gas duct 006 is cooled by a primary cooler 009, and then sent to a heat exchanger 010, where the cooled off-gas is heat exchanged. Air heated upon heat exchange is sent to the RHF 004, and fed into the furnace together with fuel. On the other hand, the off-gas is cooled again by a secondary cooler 011, and a part of the off-gas is sent to the dryer 002 as drying air for the green compacts, as stated earlier. The off-gas discharged from the dryer 002 is cleaned by a dust collector 012, and then released into the atmosphere.

The reservoir 008 accommodating the reduced compacts is passed on to a subsequent step. That is, the reduced compacts in the reservoir 008 are supplied to a raw material tank (hopper) 013, and charged into a melting furnace 015 via a chute feeder 014 for melting.

The RHF 004 of the foregoing apparatus for producing reduced iron requires that the residence time of the green compacts in the high temperature atmosphere be minimized for increased productivity. Thus, the interior of the RHF 004 needs to be heated to a high temperature of 1,200 to 1,300° C. The reduced compacts discharged from the compact discharger 007 are accommodated at a high temperature directly into the reservoir 008. In the reservoir 008, the reduced compacts stick to each other under their own weight. When the reduced compacts are charged from the reservoir 008 into the melting furnace 015 through the chute feeder 014, large lumps of the reduced compacts stuck together may clog the chute feeder 014.

Hence, it has been common practice to dispose a rotary drum type cooler immediately below the compact discharger 007 of the RHF 004, cool the hot temperature reduced compacts to ordinary temperature in this cooler, and then accommodate them into the reservoir 008. This necessitates equipment cost for the cooler, and requires a cooling time for cooling the reduced compacts to ordinary temperature. Thus, the productivity is decreased, and the forced cooling of the high temperature reduced compacts wastes the heat that the compacts per se retain.

Moreover, the high temperature atmosphere is unstable during an initial period of operation of the RHF 004. In this case, the reduced compacts are reoxidized, and heat generation during this reoxidation results in partial melting. As a result, the reduced compacts stick to each other, forming large lumps. In this case as well, when the reduced compacts are charged from the reservoir 008 into the melting furnace 015 through the chute feeder 014, large lumps of them may clog the chute feeder 014, as stated previously.

SUMMARY OF THE INVENTION

The present invention has been accomplished to solve the above-mentioned problems. It is an object of this invention to provide a method and an apparatus for producing reduced iron, which eliminate operating defects in a subsequent step due to large lumps of reduced compacts, and prevent a decrease in the efficiency of production.

A method for producing reduced iron according to the present invention, as a means of attaining the above-mentioned object, is a method for producing reduced iron by agglomerating a mixed powder of an iron material and a reducing agent to form compacts like briquettes or pellets, and reducing the compacts in a high temperature atmosphere, wherein when a temperature of reduced compacts is 900° C. or higher, and an oxide content in the reduced compacts is 11% or more.

Thus, mutual sticking of the reduced compacts can be suppressed to eliminate operating defects in a subsequent step due to large lumps of the reduced compacts, and prevent a decrease in the efficiency of production.

In the method for producing reduced iron according to the invention, basicity of the reduced compacts may be 0.5 or more. Since the basicity of the reduced compacts is 0.5 or more, mutual sticking of the reduced compacts can be suppressed reliably.

In the method for producing reduced iron according to the invention, the compacts maybe formed, with the amount of limestone mixed with the mixed powder of the iron material and the reducing agent being adjusted so that the oxide content in the reduced compacts will be 11% or higher. Thus, the adjustment can be made easily and highly accurately so that the oxide content in the reduced compacts will be appropriate.

An apparatus for producing reduced iron according to the invention is an apparatus for producing reduced iron by agglomerating a mixed powder of an iron material and a reducing agent to form compacts like briquettes or pellets, and reducing the compacts in a high temperature atmosphere, the apparatus further including grinding means for grinding reduced compacts.

Since large lumps of reduced compacts stuck together are ground by the grinding means, operating defects in a subsequent step due to large lumps of the reduced compacts can be eliminated, and a decrease in the efficiency of production can be prevented.

In the apparatus for producing reduced iron according to the invention, the grinding means may be disposed in a discharge port of an RHF, and the reduced compacts ground by the grinding means may be accommodated and stored in a reservoir. Thus, the reduced compacts in a high temperature state can be easily ground, and can be stored without being oxidized again.

In the apparatus for producing reduced iron according to the invention, sifting means may be provided for sifting the reduced compacts according to size of the compact, and large lumps of the reduced compacts sifted out by the sifting means may be ground by the grinding means. Since only large lumps of the reduced compacts are ground by the grinding means, the amount of operation of the grinding means can be decreased, and the efficiency of processing can be increased.

In the apparatus for producing reduced iron according to the invention, the sifting means may be composed of a plurality of sieves, and a vibrator for vibrating the sieves, each of the sieves being composed of a plurality of rods supported at predetermined intervals and in an inclined state on an upper portion of a body. Thus, the structure of the sifting means can be simplified and made lightweight.

In the apparatus for producing reduced iron according to the invention, reduced compacts discharged from an RHF may be sifted by the sifting means, then large lumps of the reduced compacts may be ground by the grinding means, and small lumps of the reduced compacts sifted out by the sifting means and small lumps of the reduced compacts formed by grinding by the grinding means may be accommodated and stored in a reservoir. Thus, the reduced compacts in a high temperature state can be easily ground, and can be stored without being oxidized again.

In the apparatus for producing reduced iron according to the invention, temporary storage means may be provided for temporarily storing the large lumps of the reduced compacts sifted out by the sifting means, and after a predetermined amount or a larger amount of the large lumps of the reduced compacts are stored in the temporary storage means, all of these large lumps may be ground by the grinding means. Thus, the large lumps of the reduced compacts stuck together in a transport reservoir are ground by the grinding means. Consequently, operating defects in a subsequent step due to large lumps of the reduced compacts can be prevented reliably.

In the apparatus for producing reduced iron according to the invention, a reservoir for accommodating and storing reduced compacts may be provided in a discharge port of an RHF, the grinding means may be disposed in a charge port for a raw material tank in a melting furnace, and immediately before the reduced compacts in the reservoir are charged into the raw material tank, large lumps of the reduced compacts may be ground by the grinding means. Thus, after the reduced compacts become cold, the large lumps are ground. Consequently, the reduced compacts can be prevented from resticking to each other.

In the apparatus for producing reduced iron according to the invention, sifting means for sifting the reduced compacts according to the size of the compact may be provided in the charge port for the raw material tank in the melting furnace, and large lumps of the reduced compacts sifted out by the sifting means may be ground by the grinding means and then charged into the raw material tank. Thus, after the reduced compacts become cold, only large lumps of the reduced compacts are ground by the grinding means. Consequently, resticking of the reduced compacts to each other can be prevented, the amount of operation of the grinding means can be decreased, and the efficiency of processing can be increased.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Embodiments of the present invention will now be described in detail with reference to the accompanying drawings, which in no way limit the invention.

[First Embodiment]

Figure 2:
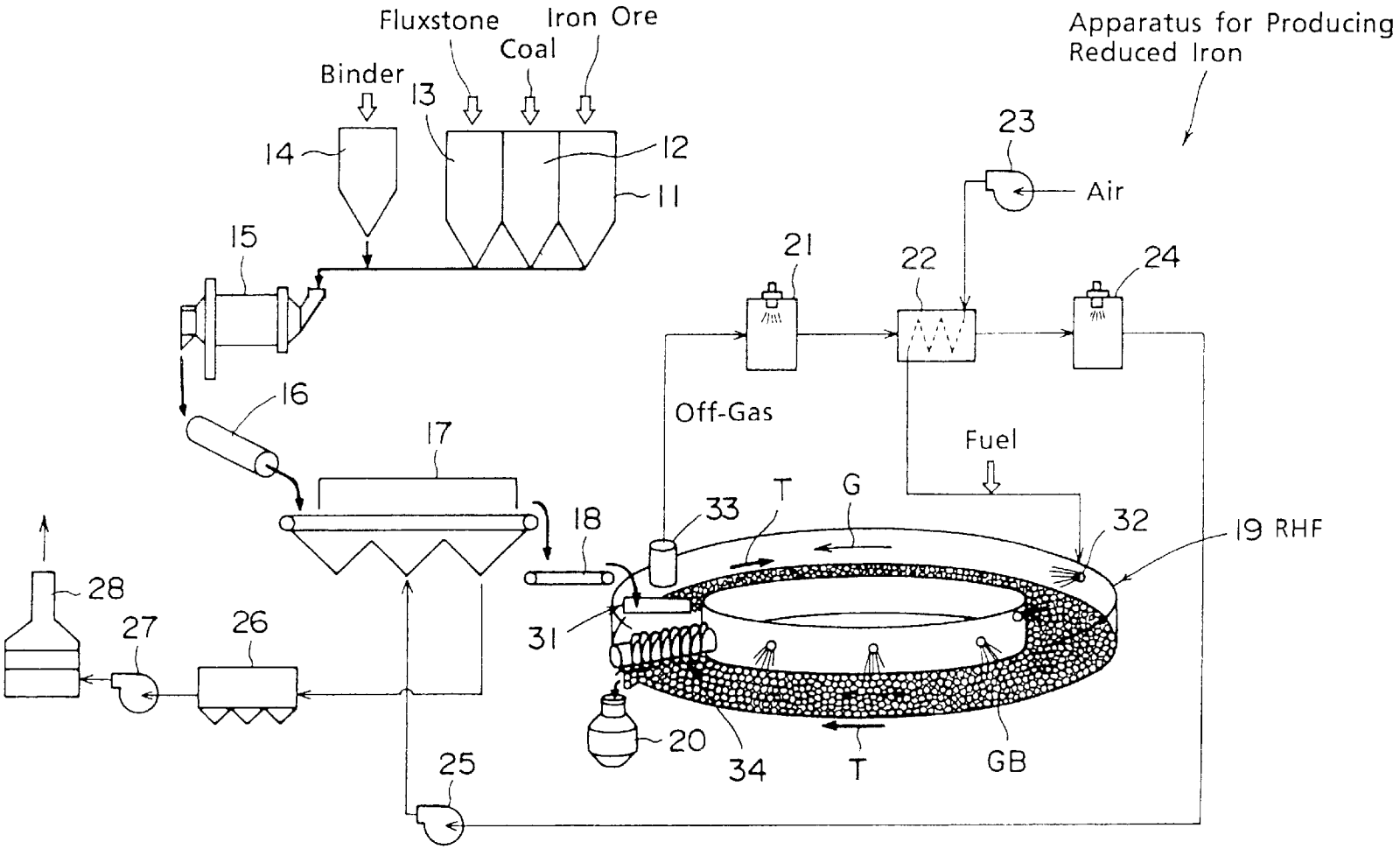
FIG. 2 is a schematic view showing an overall layout of a production apparatus for carrying out the method for producing reduced iron.

A method for producing reduced iron according to the present embodiment will be described briefly. As shown in FIG. 2, an iron ore powder (an iron material), a coal powder (a reducing agent), and a fluxstone (limestone) powder, which will be raw materials for compacts, are fed from hoppers 11, 12 and 13, respectively. Separately, a binder is fed from a hopper 14, and these materials are mixed in a mixer 15. Then, the resulting mixed powder is agglomerated by a pelletizer or a briquetter 16 to form green compacts like pellets or briquettes (raw compacts). The resulting compacts are charged into a dryer 17, where the compacts are dried with an off-gas from an RHF 19 to be described later on. The so dried green compacts are fed to the RHF 19 by a compact feeder 31 via a conveyor 18. The interior of the RHF 19 is maintained in a high temperature atmosphere upon heating by burners 32, and an off-gas inside the RHF 19 is discharged through an off-gas duct 33. Thus, the green compacts are heated at a high temperature inside the RHF 19 while moving in the RHF 19. Iron oxide in the iron ore is reduced with coal to form reduced iron in compact form. The reduced compacts are delivered from inside the RHF 19 by a compact discharger 34, and accommodated in a reservoir 20.

The off-gas discharged through the off-gas duct is cooled by a water spray type primary cooler 21, and then sent to a heat exchanger 22, where the cooled off-gas is heat exchanged with air fed by a fan 23. Then, the off-gas is cooled again by a water spray type secondary cooler 24. The air heated in the heat exchanger 22 is carried to the RHF 19, and fed into the furnace together with fuel. The off-gas cooled in the secondary cooler 24 is sent to the dryer 17 by a fan 25 to become drying air for the green compacts, as stated earlier. The off-gas discharged from the dryer 17 is cleaned by a dust collector 26, sent to a stack 28 by an off-gas fan 27 for desulfurization, and then released into the atmosphere.

Compacts before reduction (may be hereinafter referred to as "unreduced compacts"), i.e., green compacts, contain a considerable amount of iron oxide $Fe_2O_3$ contained in the iron ore as the iron material, carbon C in the coal as the reducing agent, small amounts of other iron ore components (gangue mineral components) contained in the iron ore, coal and binder, such as calcium oxide CaO, magnesium oxide MgO, potassium oxide $K_2O$, sodium oxide $Na_2O$, silicon oxide $SiO_2$, aluminum oxide $Al_2O_3$, and boron oxide $B_2O_3$. The reduced compacts, on the other hand, are composed of iron Fe reduced from iron oxide, and small amounts of iron ore components, including ash produced by combustion of carbon. The volume of the reduced compacts decreases by the amount of carbon which has vanished because it is converted to a combustion gas.

Of the above-mentioned gangue mineral components, calcium oxide CaO, magnesium oxide MgO, potassium oxide $K_2O$, and sodium oxide $Na_2O$ are alkaline oxides, while the other components, i.e., silicon oxide $SiO_2$, aluminum oxide $Al_2O_3$, and boron oxide $B_2O_3$, are acidic oxides. Thus, the basicity of the gangue mineral components remaining in the reduced compacts is determined by dividing the amount of the alkaline oxides by the amount of the acidic oxides.

The inventor of the present invention experimentally investigated changes which occur in compacts during the heating and reduction of the compacts in the RHF 19. As a result, the inventor found that the sticking of reduced compacts to each other occurred upon melting of gangue mineral components present around reduced iron during the reduction process, and this sticking was related to the amount, and degree of dispersion, of the gangue mineral components (including ash) present around iron obtained by reduction. That is, it has become clear that when the proportion of the gangue mineral type oxide components in the compact composition is less than a certain value, sticking occurs easily, but when this proportion is higher than the certain value, sticking minimally occurs.

It has also been shown that when the basicity of the gangue mineral type oxides in the compact composition is lower than a certain value, the melting point lowers and sticking occurs easily, and when the basicity is higher than the certain value, the melting point rises and sticking occurs minimally. In detail, compacts undergo a heat history at a reduction temperature of 1,200° C. or higher. Thus, to curtail sticking, a mixture of the gangue mineral components has been found to require a melting point of 1,200° C. or higher.

By fulfilling the above-described two requirements, it has been found that reduced compacts at 900° C. or higher can be hot direct charged without the need to be cooled.

By conducting experiments based on the foregoing theory, the inventor worked out a method capable of hot direct charging reduced compacts reduced at a required high temperature of 900° C. or higher without need to cool the compacts. That is, the inventor devised a method for preventing sticking when green compacts comprising a mixed powder of iron ore, coal, fluxstone, and a binder in a high temperature atmosphere in the RHF 19. According to the method, when the temperature of reduced compacts is 900° C. or higher, the oxide content in the reduced compacts is set at 11% or more, and the basicity of the reduced compacts is set at 0.5 or higher in order to raise the softening temperature during reduction.

Figure 1:
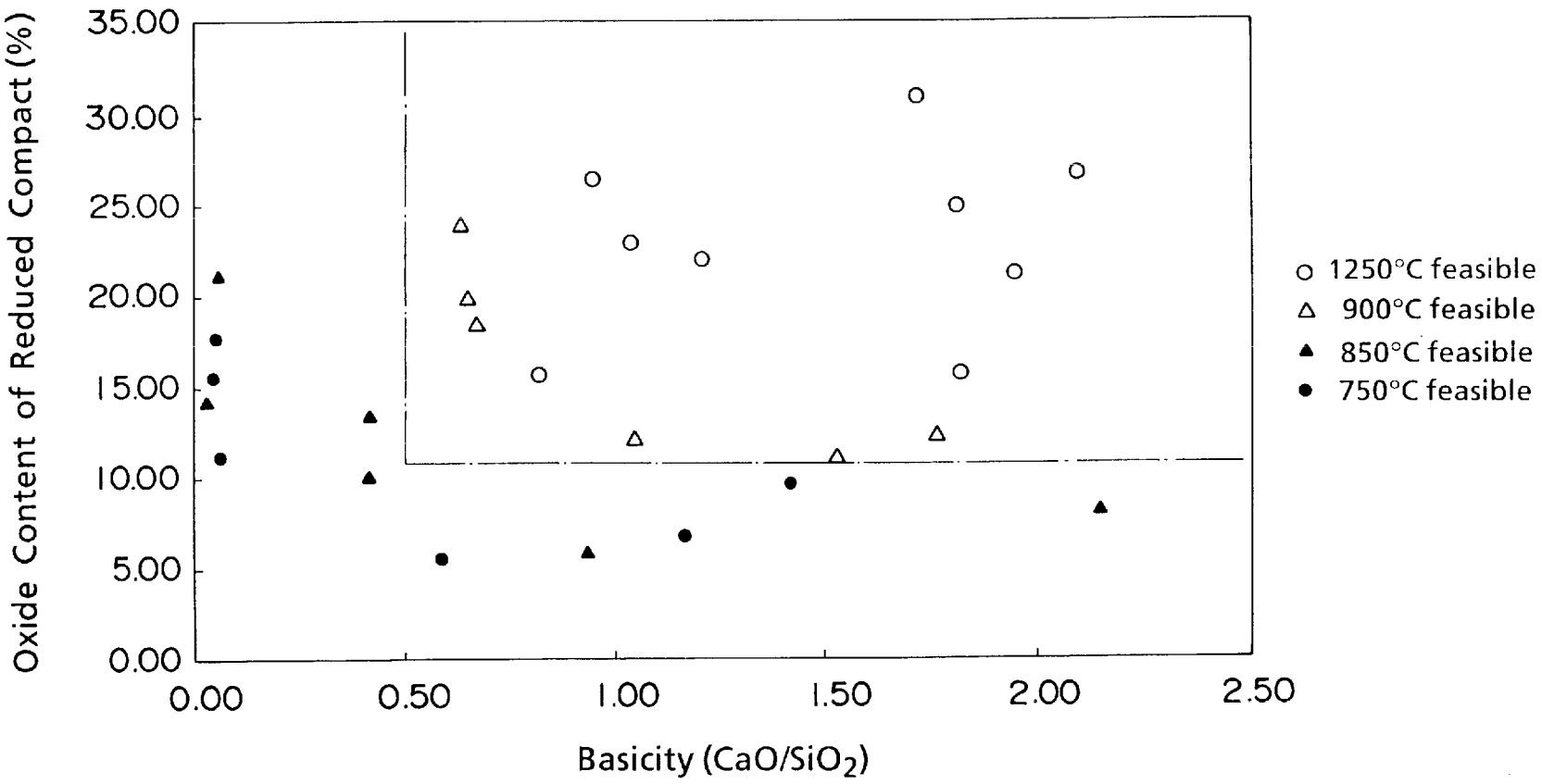
FIG. 1 is a graph showing the relation between the basicity and the oxide content of a reduced compact produced by a method for producing reduced iron according to a first embodiment of the present invention.

FIG. 1 is a graph for evaluating sticking of reduced compacts produced, with a combination of the temperature, oxide content, and basicity of the reduced compacts. being varied. In FIG. 1, ● represents a sample without sticking at a temperature of up to 750° C., ▲ represents a sample without sticking at a temperature of up to 850° C., Δ represents a sample without sticking at a temperature of up to 900° C., and ○ represents a sample without sticking at a temperature of up to 1,250° C. In reducing green compacts in the RHF 19, a temperature of 900° C. or higher is necessary to ensure quality. Thus, the optimal region is a region demarcated by a one-dot chain line in FIG. 1, i.e., a region in which the oxide content in the reduced compacts is 11% or higher, and the basicity is 0.5 or higher.

In the reduction process for the green compacts in the RHF 19, the produced compacts are actually classified into those reducible easily and those reducible with difficulty, depending on the quality of the iron ore or coal. Thus, a reduction temperature of 1,300° C. at the highest, or a lower temperature than that may be sufficient. In the reduction step for the green compacts in the RHF 19, therefore, the temperature of the reduced compacts to be discharged from the compact discharger 34 is about 900 to 1,250° C. This means that the oxide content in the reduced compacts is desirably 11% or higher, and the basicity is optimally 0.5% or higher.

As noted above, in the method for producing reduced iron according to the present embodiment, when the temperature of reduced compacts is. 900° C. or higher, the oxide content in the reduced compacts is set at 11% or more, and the basicity of the reduced compacts is set at 0.5 or higher. This is achieved by grasping the proportions of iron ore and coal which will be powdery raw materials for green compacts, and mixing fluxstone, etc. so that reduced compacts will have the aforementioned composition. Thus, mutual sticking of reduced compacts is suppressed, large lumps of reduced compacts do not clog the chute feeder, etc., and a decline in the production efficiency can be prevented.

In the above-described embodiment, clogging of the chute feeder, etc. with large lumps of reduced compacts is inhibited by preventing sticking itself. However, it is difficult for this method to prevent sticking of reduced compacts completely. In embodiments to be explained below, therefore, large lumps of reduced compacts are subjected to sieving or grinding to prevent clogging of the chute feeder, etc.

[Second Embodiment]

Figure 3:
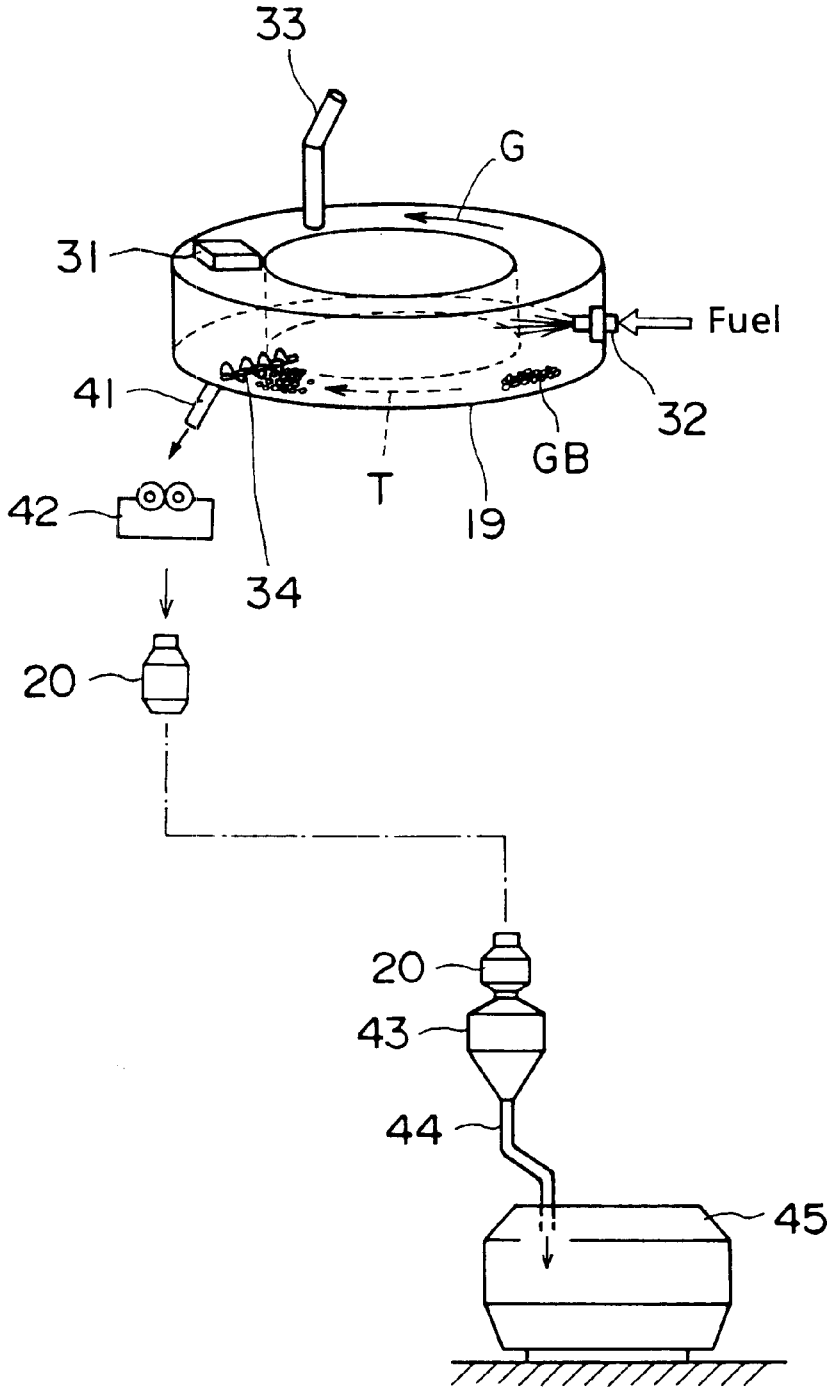
FIG. 3 is a schematic view of an apparatus for producing reduced iron according to a second embodiment of the invention.

In an apparatus for producing reduced iron according to the present embodiment, as shown in FIG. 3, an RHF 19 has a compact feeder 31 and a compact discharger 34, and also has burners 32 for maintaining compacts in a high temperature atmosphere and an off-gas duct 33 for discharging an off-gas. To the compact discharger 34, a discharge chute 41 is mounted. In an exit portion of the discharge chute 41, a grinder 42 for grinding reduced compacts is disposed, and a reservoir 20 for accommodating the ground reduced compacts is installed.

Thus, green compacts formed from a mixed powder of iron ore, coal, fluxstone and a binder are fed to the RHF 19 by the compact feeder 31. While the green compacts are moving in the RHF 19, they are heated to a high temperature. Iron oxide in the iron ore is reduced with the coal to form reduced iron in compact form. The reduced compacts, which have been delivered from inside the RHF 19 by the compact discharger 34, are sent to the grinder 42. Large lumps of the reduced compacts stuck together are ground by the grinder 42, and accommodated in the reservoir 20.

The reservoir 20 accommodating the reduced compacts is passed on to a subsequent step. That is, the reduced compacts in the reservoir 20 are supplied to a raw material tank (hopper) 43, charged into a melting furnace 45 via a chute feeder 44, and melted there.

In the apparatus for producing reduced iron according to the present embodiment, as described above, the reduced compacts, which have been discharged by the compact discharger 34 of the RHF 19, are ground by the grinder 42, and accommodated in the reservoir 20. Hence, even if the reduced compacts stick to each other, lumps formed by the sticking are. ground by the grinder 42. Consequently, the reduced compacts are not accommodated in the reservoir 20 as large lumps, so that when the reduced compacts inside the reservoir 20 are charged into the melting furnace 45 from the raw material tank (hopper) 43, they do not clog the chute feeder 44.

[Third Embodiment]

Figure 4:
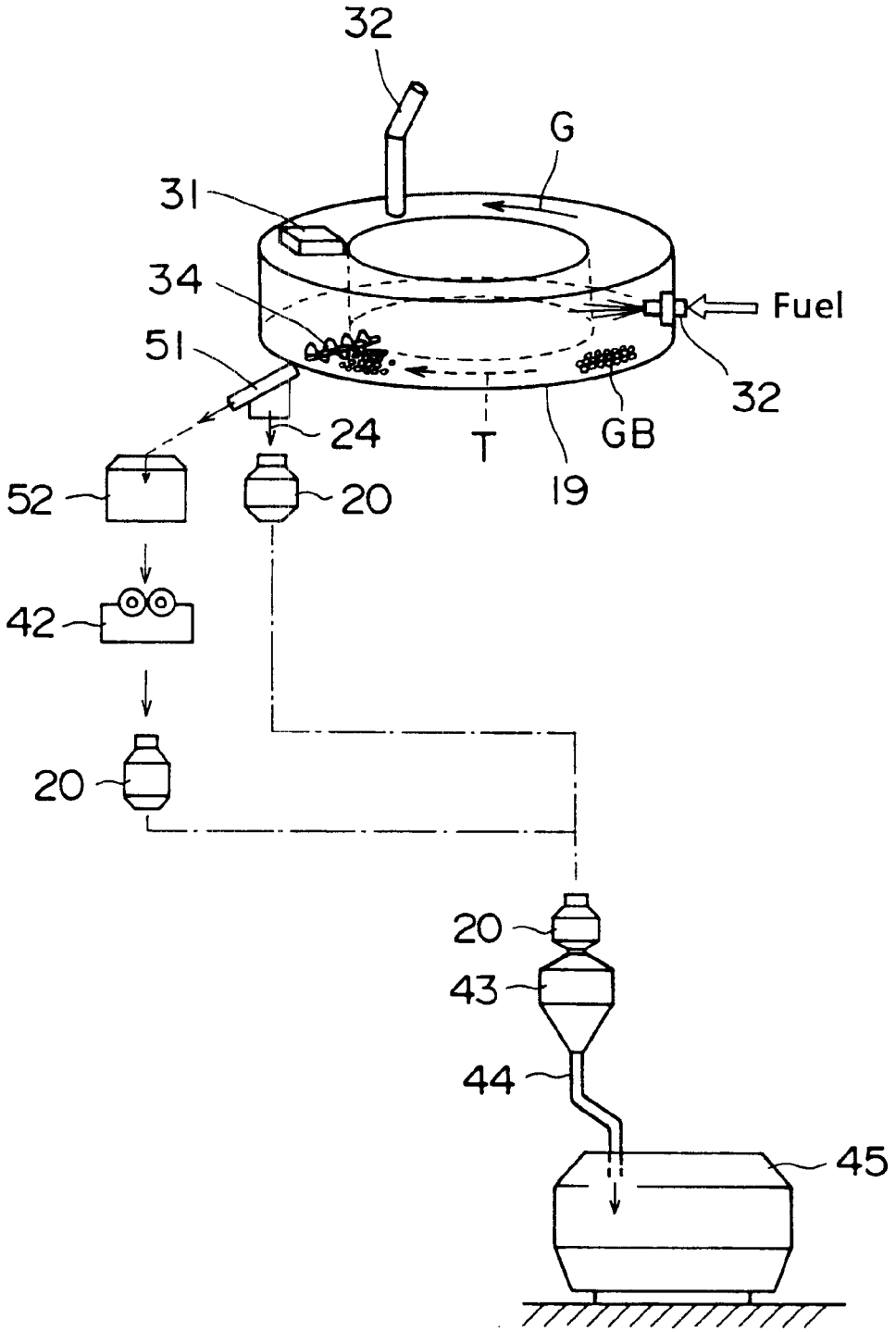
FIG. 4 is a schematic view of an apparatus for producing reduced iron according to a third embodiment of the invention.

In an apparatus for producing reduced iron according to the present embodiment, as shown in FIG. 4, a sifter 51 is disposed it a discharge portion of a compact discharger 34 in an RHF 19. The sifter 51 can sift the reduced compacts to pick up large lumps of the reduced compacts that have been formed by mutual sticking. Beside a discharge portion of the sifter 51 for the reduced compacts passing through the sifter 51, a reservoir 20 is disposed. Beside a discharge portion of the sifter 51 for large lumps of the reduced compacts sifted out by the sifter 51, a container 52 is disposed for temporarily accommodating the large lumps of the reduced compacts. Adjacent to the container 52, there are mounted a grinder 42 for grinding the large lumps of the reduced compacts, and a reservoir 20 for accommodating the reduced compacts after grinding.

Figure 5:
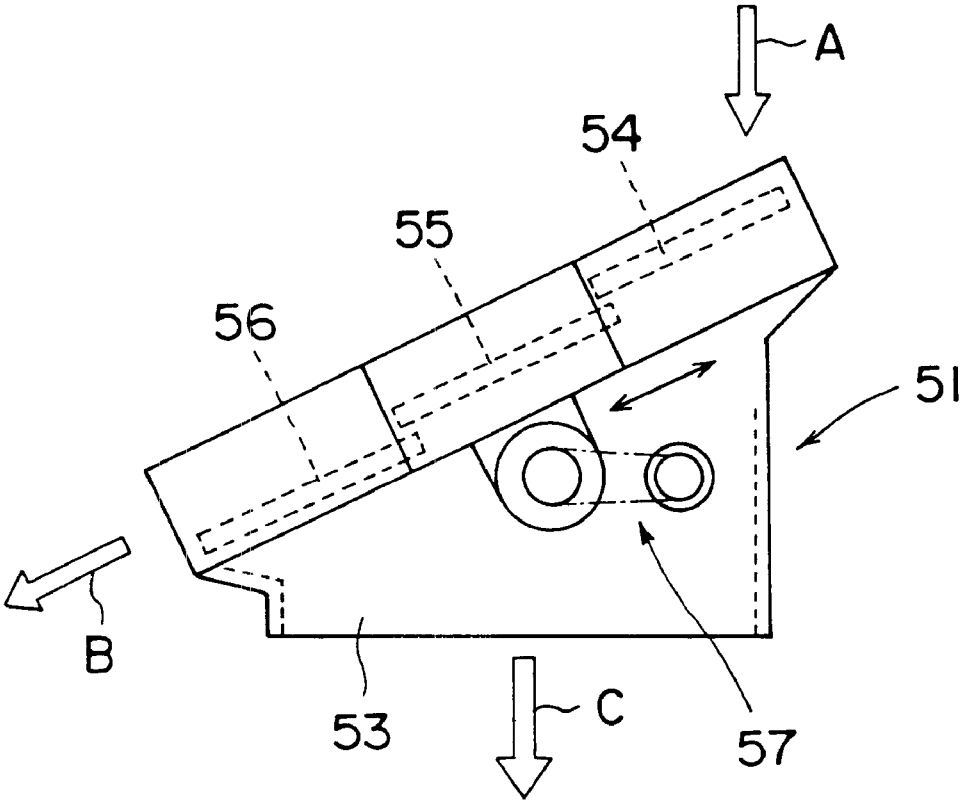
FIG. 5 is a front view of a sifter.
Figure 6:
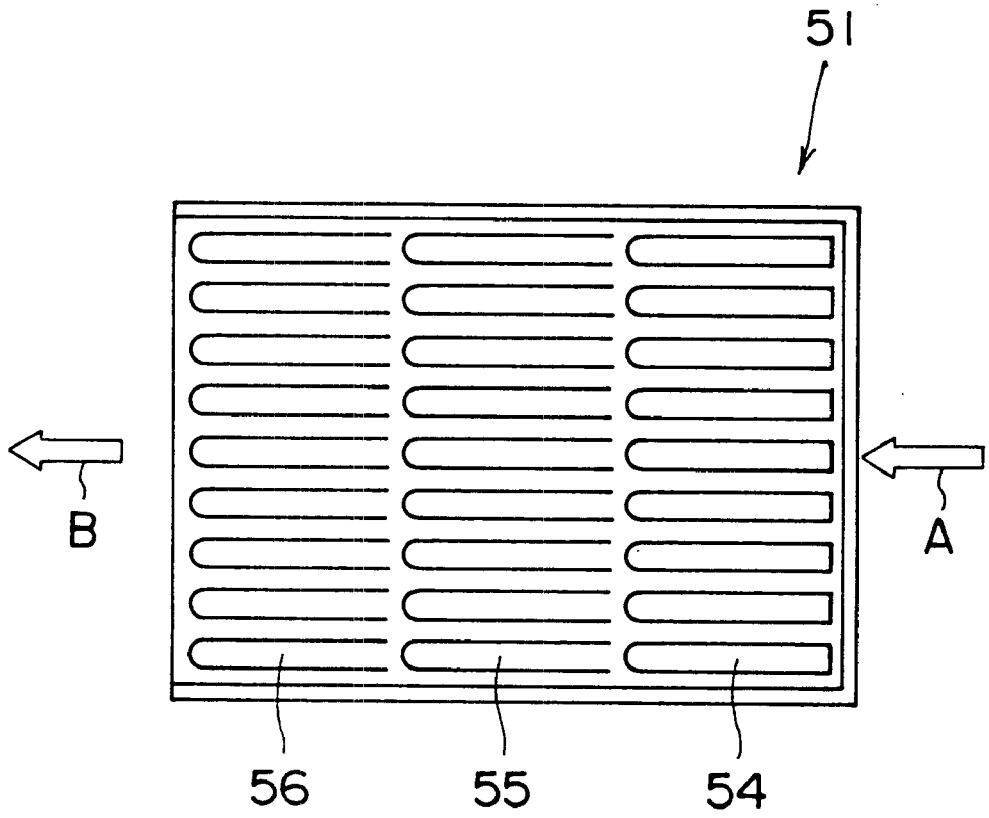
FIG. 6 is a plan view of the sifter.

The sifter 51, as shown in FIGS. 5 and 6, is composed of a plurality of rods mounted at predetermined intervals and in an inclined state on an upper portion of a body 53, e.g., three sieves 54, 55 and 56, and a vibrator 57 for vibrating these sieves 54, 55 and 56. These sieves 54, 55 and 56 have rod-to-rod gaps each measuring, for example, about 100 mm. Reduced compacts having a diameter smaller than this gap fall through this gap, while large lumps of reduced compacts having a greater diameter than this gap roll on an inclined surface and fall forward.

Thus, when green compacts are reduced in a high temperature atmosphere inside the RHF 19, they are delivered by the compact discharger 34, and sent to the sifter 51. In the sifter 51, reduced compacts are fed from the direction of an arrow A onto the sieves 54, 55 and 56 vibrated by the vibrator 57. Reduced compacts, which have not stuck to each other, fall through the rod-to-rod gaps of the sieves 54, 55 and 56 in the direction of an arrow C, and are then accommodated in the reservoir 20. Whereas large lumps of reduced compacts stuck together roll on the inclined surface on the sieves 54, 55 and 56, fall in the direction of an arrow B, and are then accommodated in the container 52. After the large lumps of the reduced compacts in the container 52 are heaped to a certain extent, they are sent to the grinder 42. The large lumps are ground by the grinder 42 and accommodated in the reservoir 20. Then, the reservoir 20 accommodating the reduced compacts is passed on to a subsequent step. That is, the reduced compacts in the reservoir 20 are supplied to a raw material tank 43, charged into a melting furnace 45 via a chute feeder 44, and melted there.

In the apparatus for producing reduced iron according to the present embodiment, reduced compacts discharged from the compact discharger 34 of the RHF 19 are separated by the sifter 51 into reduced compacts which have not stuck to each other, and large lumps of reduced compacts formed by mutual sticking. The large lumps of reduced compacts are temporarily heaped in the container 52, ground altogether by the grinder 42, and accommodated in the reservoir 20. Hence, only large lumps of reduced compacts are ground by the grinder 42. Compared with the preceding embodiment, the amount of operation of the grinder 42 can be decreased, and the processing efficiency can be increased. As in the preceding embodiment, moreover, clogging of the chute feeder 44 can be prevented when the reduced compacts in the reservoir 20 are charged into the melting furnace 45 from the raw material tank 43.

[Fourth Embodiment]

Figure 7:
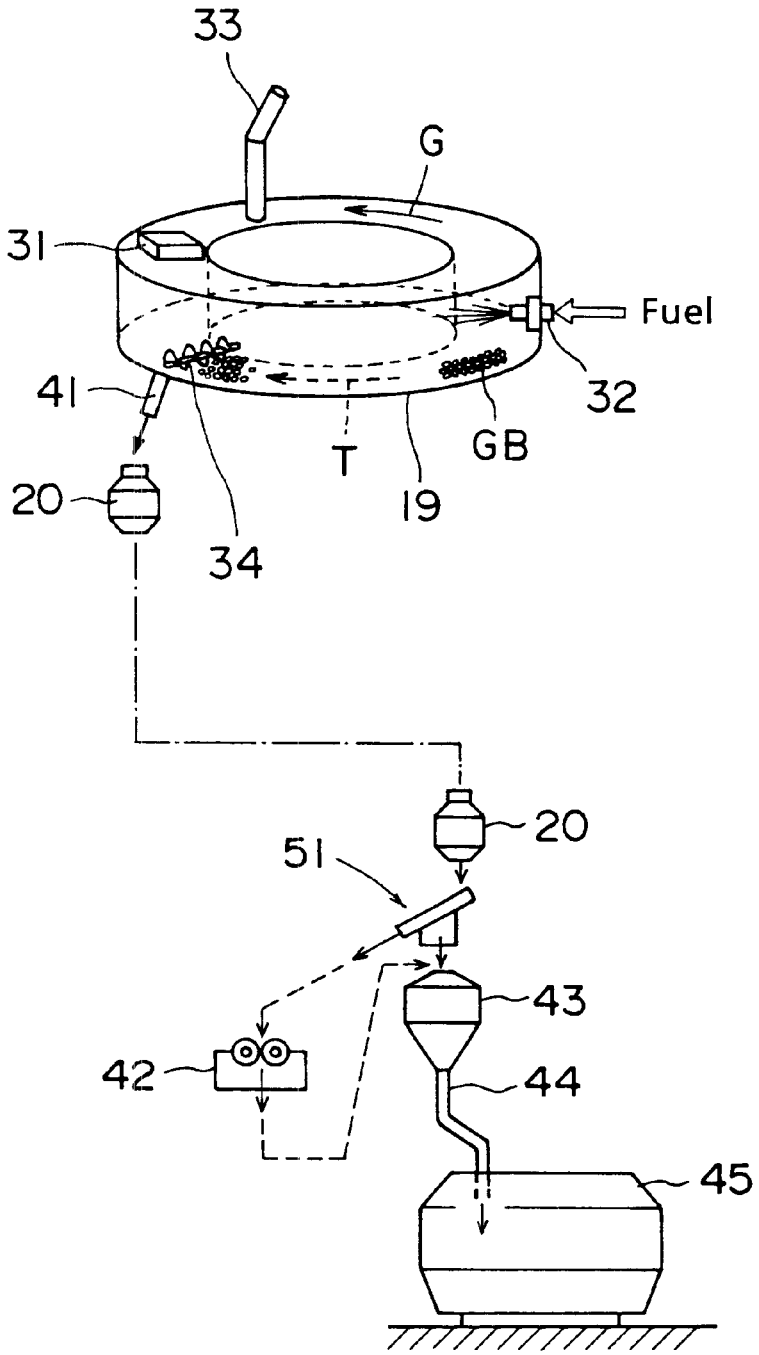
FIG. 7 is a schematic view of an apparatus for producing reduced iron according to a fourth embodiment of the invention.
Figure 8:
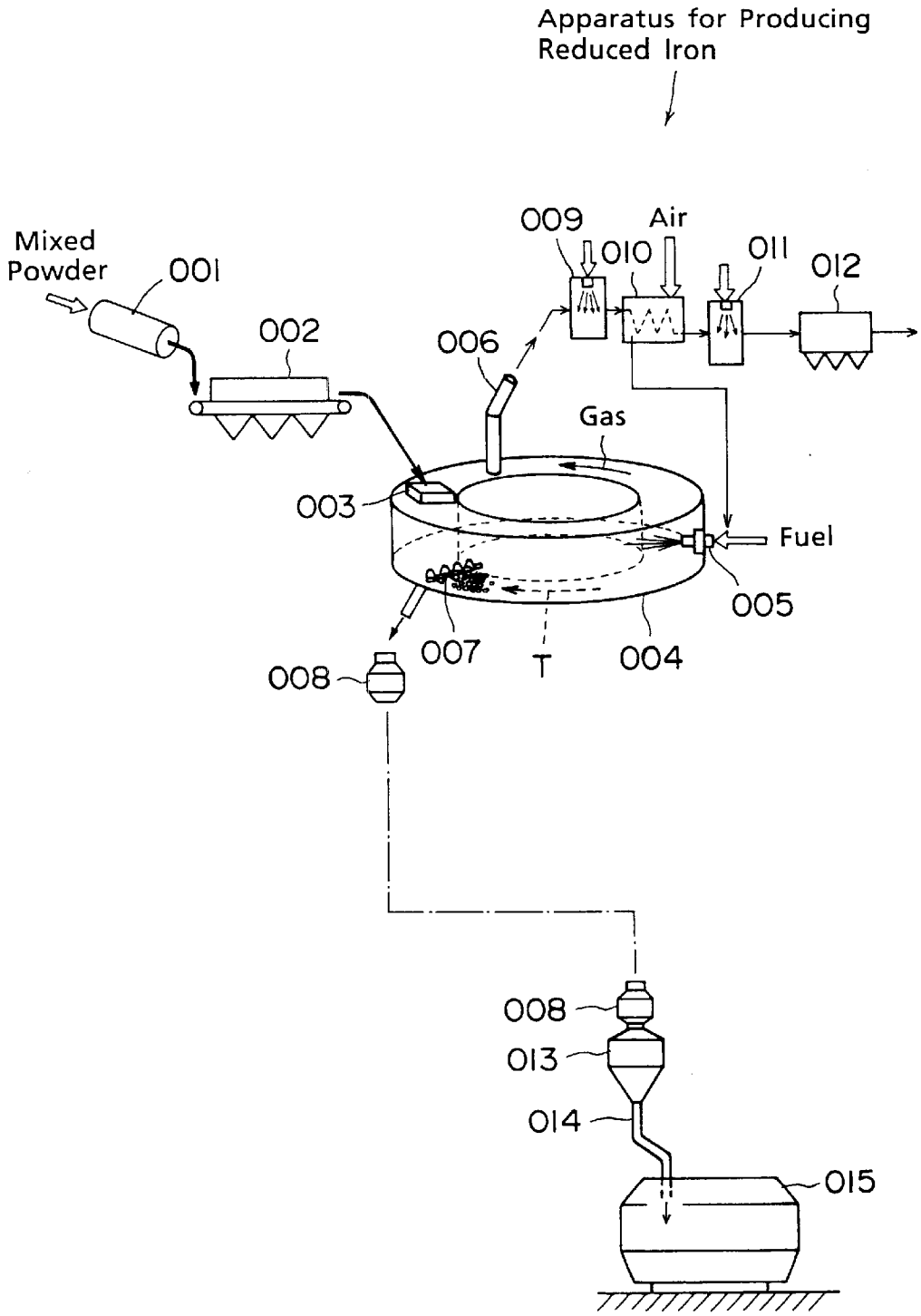
FIG. 8 PRIOR ART
FIG. 8 is a schematic view showing a production process by a conventional apparatus for producing reduced iron.

In an apparatus for producing reduced iron according to the present embodiment, as shown in FIG. 7, a sifter 51 for sifting reduced compacts in a reservoir 20 is disposed beside a supply portion of a raw material tank 43 from which reduced compacts are charged into a melting furnace 45 via a chute feeder 44. A grinder.42 is disposed beside a discharge portion of the sifter 51 for large lumps of the reduced compacts sifted out by the sifter 51.

Thus, when green compacts are reduced in a high temperature atmosphere inside an RHF 19, they are delivered by a compact discharger 34, and accommodated in the reservoir 20. Then, the reservoir 20 accommodating the reduced compacts is passed on to a subsequent step. That is, the reduced compacts in the reservoir 20 are sent to the sifter 51 before their supply to the raw material tank 43. In the sifter 51, reduced compacts, which have not stuck to each other, fall downward, and accommodated in the raw material tank 43. Whereas large lumps of reduced compacts stuck together are sent to the grinder 42, and after being ground by the grinder 42, they are charged into the raw material tank 43. The reduced compacts are charged from the raw material tank 43 into the melting furnace 45 via the chute feeder 44, and melted there.

In the apparatus for producing reduced iron according to the present embodiment, as described above, reduced compacts inside the reservoir 20 are separated by the sifter 51 into reduced compacts which have not. stuck to each other, and large lumps of reduced compacts formed by mutual sticking. The large lumps of reduced compacts are ground by the grinder 42, and then charged into the raw material tank 43. Thus, even large lumps of reduced compacts formed by mutual sticking in the reservoir 20 are ground by the grinder 42, and then charged into the raw material tank 43. Consequently, clogging of the chute feeder 44 can be prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing reduced iron by agglomerating a mixed powder of an iron material and a reducing agent to form compacts like briquettes or pellets, and reducing the compacts in a high temperature atmosphere, which method suppresses mutual sticking of the reduced compacts, wherein:

a temperature of reduced compacts is 900° C. or higher, the basicity of the reduced compacts is 0.5 or more, and an oxide content in the reduced compacts is 11% or more, whereby any tendency of the reduced compacts to stick to each other to form lumps is significantly reduced.

2. The method for producing reduced iron as claimed in claim 1, wherein:

the compacts are formed, with the amount of limestone mixed with the mixed powder of the iron material and the reducing agent being adjusted so that the oxide content in the reduced compacts will be 11% or higher.

3. The method for producing reduced iron as claimed in claim 1, wherein:

when the compacts are subjected to a high temperature atmosphere, the weight of thee reduced compacts does not cause those reduced compacts to stick together to form lumps.

* * * * *

UNITED STATES PATENT AND TRADEMARK OFFICE

CERTIFICATE OF CORRECTION

PATENT NO. : 6,451,085 B1
DATED : September 17, 2002
INVENTOR(S) : Kamikawa et al.

It is certified that error appears in the above-identified patent and that said Letters Patent is hereby corrected as shown below:

Title page, Item [54] and Column 1, lines 1 and 2,
should read -- METHOD AND APPARATUS FOR PRODUCING REDUCED IRON --

Signed and Sealed this

Twenty-seventh Day of May, 2003

JAMES E. ROGAN
*Director of the United States Patent and Trademark Office*